US005558253A

United States Patent [19]

Malvasio

[11] Patent Number: 5,558,253

[45] Date of Patent: Sep. 24, 1996

[54] LIGHTWEIGHT AND STRENGTH-REINFORCED TACO PLATE

[76] Inventor: William A. Malvasio, 608 Brown's Lake Dr., Burlington, Wis. 53105

[21] Appl. No.: 570,587

[22] Filed: Dec. 11, 1995

[51] Int. Cl.[6] ..... B65D 5/4805

[52] U.S. Cl. ..... 220/575; 220/556; 206/515

[58] Field of Search ..... 220/507, 575, 220/574, 23.8, 556; D7/504, 500, 505, 553, 554, 555; 99/426, 441; 206/565, 561, 515

[56] References Cited

U.S. PATENT DOCUMENTS

| | | | |
|---|---|---|---|
| D. 115,876 | 7/1939 | Deynzer | 220/575 |
| D. 270,130 | 8/1983 | Fox | D7/554 |
| D. 284,341 | 6/1986 | Zajac et al. | D7/554 |
| D. 297,797 | 9/1988 | Roberts | D7/504 |
| D. 354,197 | 1/1995 | Fish | D7/504 |
| 2,896,809 | 7/1959 | Metzger et al. | 220/23.8 |
| 2,944,696 | 7/1960 | Effgen | 220/507 |
| 5,497,885 | 3/1996 | Sussman | 220/575 |

*Primary Examiner*—Stephen J. Castellano
*Attorney, Agent, or Firm*—Arthur J. Hansmann

[57] ABSTRACT

A taco plate of a circular configuration which includes a base portion, a part of which is planar and the other part of which has integrally extending taco shell supporting walls thereabove. A circular rim is disposed around the entire plate, and the entire plate is made of one material which is integral to all portions of the plate and is of one thickness for a lightweight plate. The walls extend to the height of the encircling rim around the base and are integral with the rim, and the upper and lower plate profile surface is similar for stacking the plates adjacent each other.

4 Claims, 2 Drawing Sheets

FIG. 1
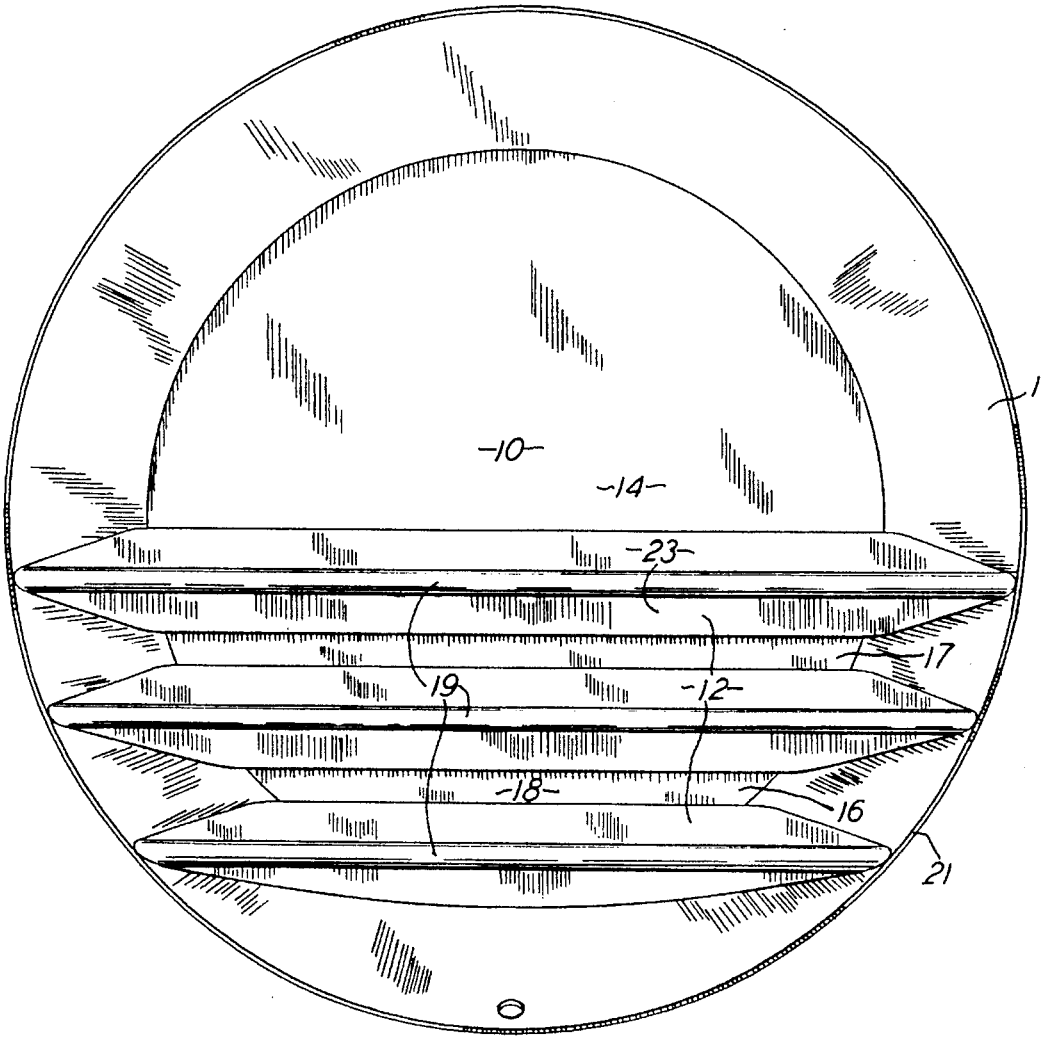
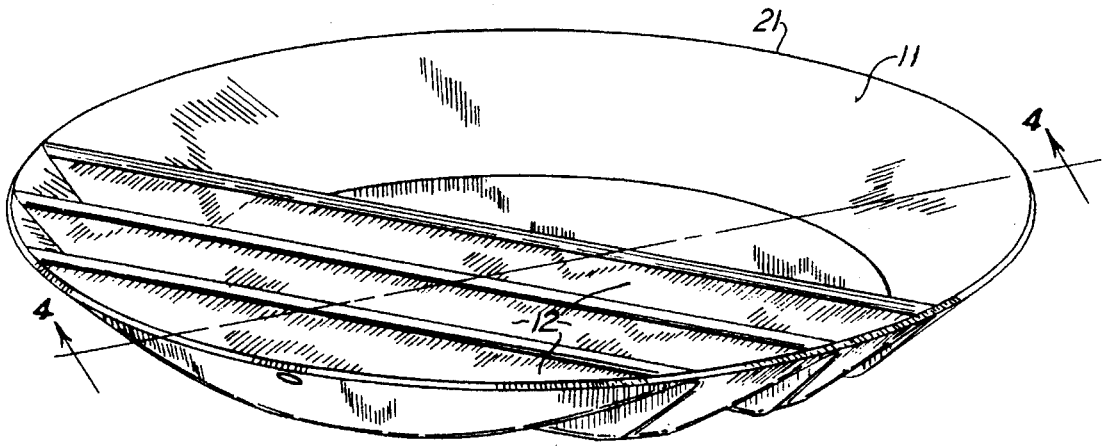
FIG. 2

FIG. 3
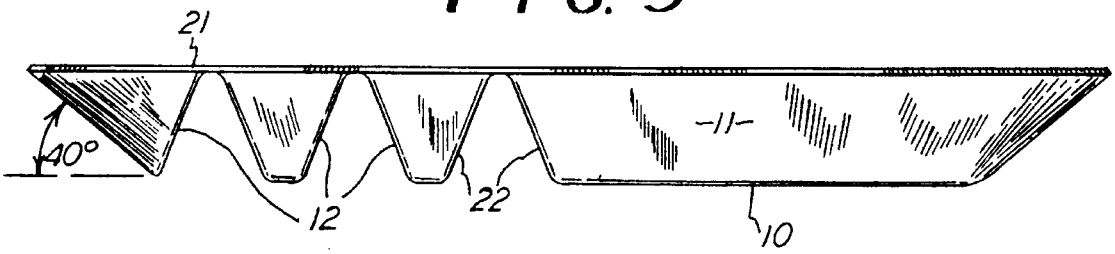
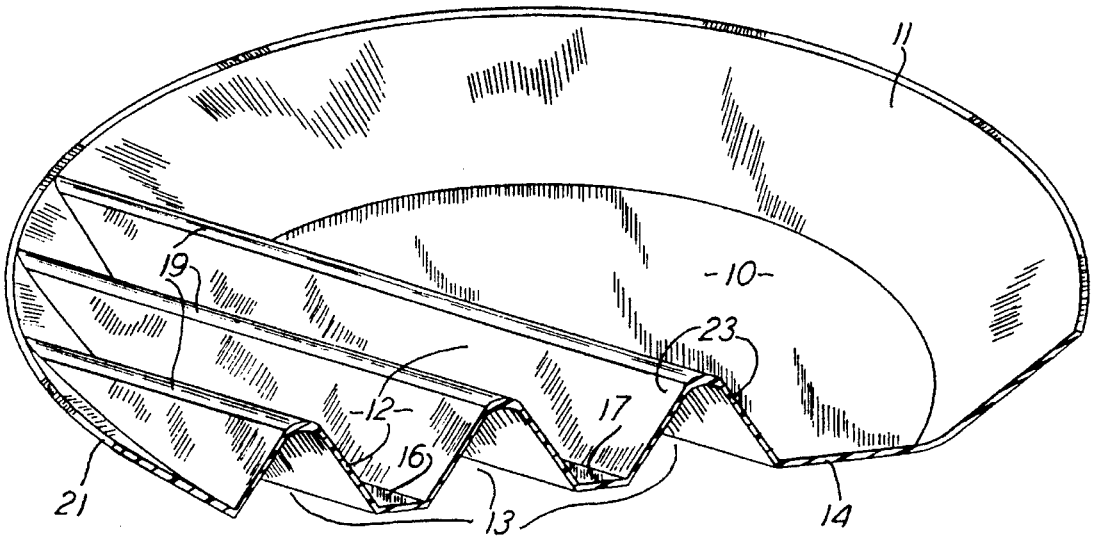
FIG. 4

LIGHTWEIGHT AND STRENGTH-REINFORCED TACO PLATE

This invention relates to a taco plate, and more particularly it relates to a lightweight and strength-reinforced taco plate.

BACKGROUND OF THE INVENTION

Taco plates are already well known in the prior art. The inventor herein has submitted samples of prior art, such as those shown in U.S. patents, and the submission is in a document accompanying this presentation for inventor's patent. As in the present invention, the prior art includes taco plates which have upstanding spaced-apart walls for supporting a taco shell, and those plates also have open areas without the upstanding walls, for supporting other foods. Also, those prior art taco holders or plates are arranged in various geometric configurations, including a circular-shaped plate, such as that of the present invention.

The present invention differs from the prior art in that it presents a circular type of taco plate with an annular rim extending around a base, and with a portion of the base being planar and with the remaining portion of the base having the upstanding walls supporting the taco shell, In that arrangement, the upstanding walls are interconnected with an integral part of an annular rim extending around the plate, and, as such, the plate is strength-reinforced by virtue of the continuity and location of the walls relative to the plate base and surrounding rim. That is, the plate is strengthened against bending and twisting, particularly under the weight of the foods supported by the plate.

Still further, the plate of the present invention is of a minimum amount of construction material, particularly plastic material, and it is therefore of one uniform thickness throughout its entire construction but it nevertheless retains its function of supporting foods and to do so in an optimum strength arrangement.

Further, the plate of this invention is arranged to support taco shells between spaced apart walls and to have the remainder of the plate on a planar arrangement for supporting other foods, and with the entire plate being arranged with a minimum of crevices or terminal elements and ridges which are otherwise susceptible to collecting and retaining foods and to therefore impede easy and complete cleaning and re-use of the plate. That is, the taco supporting walls of the prior art are generally not coterminous with the plate rim to extend to the upper level of the rim and therefore blend therewith and thereby avoid the presentation of crevices which are susceptible to the concealing and containment of foods to a detriment of the cleaning of the plate, Still further, the taco plate of this invention accomplishes the aforementioned objectives and it does so with a plate which has an upper surface and a lower surface of a similar profile so that the plate can be readily compactly stacked one on top of the other, both for storage by the user as well as the retailer.

An overall and novel objective in the present invention is to make the plate lightweight, of minimum material, visually attractive, inexpensive, strength reinforced, and stackable. In the ultimate, the plate of this invention will adequately support food stuff without bending such as in contrast to prior plates which are flimsy and permit foodstuffs to fall off a plate which bends under the weight of the food. At the same time, the plate of this invention is readily cleanable, and thus reusable, by the consumer, and the plate has a very minimum of corners, and crevices so that food is not at all as likely to cling or be concealed on the plate during the cleaning process.

BRIEF DESCRIPTION OF THE DRAWINGS

FIG. 1 is a top plan view of the taco plate of this invention.

FIG. 2 is a top perspective view, of the taco plate of FIG. 1.

FIG. 3 is a side elevational view of the taco plate of FIG. 1.

FIG. 4 is a sectional view taken on the plane 4—4 of FIG. 2.

DETAILED DESCRIPTION OF THE PREFERRED EMBODIMENT

The taco plate in the preferred embodiment, and such as that shown in the accompanying drawings, consists of only three basic portions, namely, the circular base 10, the annular rim 11, and the upstanding and spaced-apart walls 12. These three portions are all integral, that is, they are made of only one material which is moldable and preferably polypropylene. That is, in a plastic molding process, the complete plate is made of only one material which is integral or continuous throughout the entire plate. The three portions of the plate are thus all interjoined or connected to each other, and the material forming the entire plate is of only one thickness throughout the entire plate, such as that indicated particularly in FIG. 4. That thickness is preferably less than one-tenth of one inch throughout the plate, and the overall diameter of the plate can be ten inches and approximately one inch high or deep, with those two extents shown in FIG. 3. As such, it will be seen and understood that the complete height of the rim 11 and also the complete height of the walls 12 are of the same dimension or that is they terminate at the same upper elevation. Further, as indicated in the drawings, the walls 12 and the rim 11 are integral and the plastic material forming those two portions flow continuously relative to each other, as well as with the base portion 10 being integral with the rim 11 and the walls 12.

Accordingly, the drawings show that the walls 12 are of an inverted V-shape and thus present the downwardly facing hollow openings 13. Further, the walls 12 extend in geometric chordlike arrangement across the lower half of the rim 11, such as viewed in FIG. 1, and, as such, the walls 12 stiffen and reinforce the plate, compared to a plate where the walls are not connected with the rim 11 or are not integral with the rim 11 and the base 10. Therefore, the walls 12 strength-reinforce the plate and protect it from abnormal twisting or certain bending under the weight of food thereon, even though the plate is made of one thickness of material and is relatively lightweight, certainly compared to the strength produced by virtue of the walls 12 which service as reinforcing ribs across the plate.

The base portion 10 is in two sections, namely the semi-circular section 14 and the other half or section 16 on which the three walls 12 are disposed. That is, the base half designated 16 has the interspaced planar portions 17 and 18 interposed between the two longer ones of the walls 12. Of course the upstanding walls 12 are suitable for upwardly supporting a U-shaped taco shell unshown herein, which is commonly used in taco food preparations for supporting the taco meat within the shell, and of course the U-shaped shells would extend well above the upper extents at 19 of the three walls 12 and those extents are of course on the same plane which is that plane where the upper edge 21 of the rim 11 is disposed.

The rim 11 is actually disposed at an angle of 40 degrees with the horizontal, as shown in FIG. 3, and the wall surfaces 22 are all at the same obtuse angulation relative to the plane of the base 10, and that angulation is approximately 70 degrees. In that arrangement, the profile of the plates upper surface and the profile of the plates lower surface are similar and therefore they nest together and are stackable. That is, each of the walls 12 has two sides 23 which are angulated to each other to produce the inverted V-shape particularly shown in FIGS. 3 and 4.

With the walls 12 extending into integral relationship with the rim 11, there is no open space therebetween, and thus there is no opportunity for food to undesirably collect at that location, and thus the plate can be sanitary and readily cleaned.

In the arrangement shown, two taco shells can be supported between the three walls 12, with one shell being located between every two adjacent walls 12.

Where a user holds the plate at the side thereof, such as the left side as viewed in FIG. 1 and thus at the left ends of the walls 12, the wall portions 19 and 23 present the strength in the plate, and thus resist the bending of the plate under the weight of food placed along the base 10 and even on the rim 11 to the opposite side of the user's grip. Thus the common problem with prior art thin plates, namely, the lack of bending or beam strength, thus collapsing to the extent that food falls from the plate, is avoided in this particular arrangement.

What is claimed is:

1. A lightweight and strength-reinforced taco plate with two holders, comprising a plate made in one sheet having a uniform thickness throughout and including a circular base with one-half thereof being planar, a plurality of parallel chord-like walls extending completely across the half of said base opposite said one-half, said walls each being shaped in inverted V-shape and spaced apart, an upstanding completely annular rim integral with said base and extending completely therearound, said base and said walls and said rim all being integral and all being formed of only plastic and moldable material, and the height of said walls and said rim being the same, one of said walls extends diametrically across said base and thereby divides, said base into two semi-circular halves which present the aforesaid halves, and with said walls being liquid tight with said base and said rim up to the full height of said walls, for preventing liquid flow between said base halves.

2. The lightweight and strength-reinforced taco plate as claimed in claim 1, wherein said plate nests with other of said plates by virtue of said rim being disposed at an obtuse angle relative to said base and said walls being hollow from underneath said plate, all for nesting the plurality of said plates in stacked positions on top of each other.

3. The lightweight and strength-reinforced taco plate as claimed in claim 1, wherein the respective upper surface and lower surface throughout the extent of said plate are of an identical profile and at certain angulations such that a stack of said plates is in compact and nested relationship with each one of said plates in contact with another one of said plates.

4. The lightweight and strength-reinforced taco plate as claimed in claim 1, wherein said plate nests with other of said plates by virtue of said rim and said walls being disposed at obtuse angles relative to said base, and said walls being hollow from underneath said plate, all for nesting a plurality of said plates in stacked positions adjacent each other.

* * * * *